US006917769B2

(12) United States Patent
Hattori

(10) Patent No.: US 6,917,769 B2
(45) Date of Patent: Jul. 12, 2005

(54) IMAGE FORMING DEVICE THAT DETECTS APPROPRIATENESS OF TONER USED THEREIN

(75) Inventor: Tomoaki Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/446,782

(22) Filed: May 29, 2003

(65) Prior Publication Data

US 2003/0228162 A1 Dec. 11, 2003

(30) Foreign Application Priority Data

Jun. 5, 2002 (JP) ..... 2002-164006

(51) Int. Cl.[7] ..... G03G 15/08
(52) U.S. Cl. ..... 399/27; 399/29
(58) Field of Search ..... 399/27, 29, 24

(56) References Cited

U.S. PATENT DOCUMENTS 6,381,420 B1 * 4/2002 Sato et al. ..... 399/27

FOREIGN PATENT DOCUMENTS

| | | | | |
|---|---|---|---|---|
| JP | 60-50562 A | * | 3/1985 | |
| JP | 60050562 A | * | 3/1985 | ..... G03G/15/08 |
| JP | 60-79374 A | * | 5/1985 | |
| JP | 60079374 A | * | 5/1985 | ..... G03G/15/08 |
| JP | 4-18859 | | 2/1992 | |
| JP | 05006093 A | * | 1/1993 | ..... G03G/15/08 |
| JP | 09-166917 | | 6/1997 | |
| JP | 10171235 A | * | 6/1998 | ..... G03G/15/08 |
| JP | 11084757 A | * | 3/1999 | ..... G03G/15/00 |
| JP | 11095556 A | * | 4/1999 | ..... G03G/15/08 |
| JP | 11-119526 A | * | 4/1999 | |
| JP | 2000010424 A | * | 1/2000 | ..... G03G/15/16 |
| JP | 2000029297 A | * | 1/2000 | ..... G03G/15/08 |
| JP | 2000-347492 A | * | 12/2000 | |
| JP | 2000347492 A | * | 12/2000 | ..... G03G/15/08 |
| JP | A 2001-100599 | | 4/2001 | |
| JP | A 2001-125377 | | 5/2001 | |
| JP | A 2001-255725 | | 9/2001 | |
| JP | 2002023475 A | * | 1/2002 | ..... G03G/15/08 |

* cited by examiner

*Primary Examiner*—Quana Grainger
(74) *Attorney, Agent, or Firm*—Oliff & Berridge, PLC

(57) ABSTRACT

Developing cartridges, each including a developing roller for carrying toner, are detachably mounted in a color laser printer. A drive current of a motor driving the developing rollers is detected as a load applied to a driving motion of the motor. If appropriate toner is being used, then the detected drive current is equal to or less than a predetermined value. However, if inappropriate toner is being used, then the detected drive current is greater than the predetermined value. In this case, printing is canceled so as to prevent formation of images with inappropriate toner and potential damage to the color laser printer.

18 Claims, 3 Drawing Sheets

IMAGE FORMING DEVICE THAT DETECTS APPROPRIATENESS OF TONER USED THEREIN

BACKGROUND OF THE INVENTION

1. Field of the Invention

The present invention relates to an image forming device, such as a laser printer.

2. Description of the Related Art

Conventional laser printers and other image forming devices that employ an electrophotographic system include developing cartridges that are detachably mounted in the image forming device. Each cartridge includes a toner hopper that accommodates toner and a developing roller used to carry toner stored in the toner hopper. This type of developing cartridge is mounted in the image forming device, such that the developing roller in the cartridge is positioned in opposition to a photosensitive drum. Hence, when toner carried on the developing roller is moved into a position opposite the photosensitive drum, electrostatic latent images formed on the photosensitive drum are developed to form visible toner images, which are then transferred onto a recording sheet by a transfer roller.

Ordinarily, an empty sensor is also provided in this type of image forming device to detect when the toner hopper in the developing cartridge becomes empty. When the sensor detects that the toner hopper is empty, a message is displayed to a user indicating that the cartridge is out of toner, prompting the user to replace the developing cartridge. In response, the user removes the empty developing cartridge currently mounted in the image forming device and installs a new developing cartridge in its place.

Toner used in this type of image forming device is designed to be suitable for specific image forming devices in order to achieve maximum performance. Accordingly, if the user mistakenly mounts a developing cartridge filled with toner that is not appropriate for the image forming device, this inappropriate toner may have an adverse effect on image quality, even if the developing cartridge can be mounted in the image forming device and used to perform printing. If used for a long period of time, the inappropriate toner may invite damage to the image forming device and may cause malfunctions that could render the image forming device inoperable. However, it is not easy for the user to determine whether a certain toner is appropriate for the image forming device.

SUMMARY OF THE INVENTION

In view of the foregoing, it is an object of the present invention to overcome the above problems and also to provide an image forming device that can prevent degraded quality in image formation and damage to the image forming device when an inappropriate developing agent is used.

In order to attain the above and other objects, the present invention provides an image forming device including a casing, a developing device that is detachably mounted in the casing, the developing device including a developing agent carrying member for carrying a developing agent, a drive source for driving the developing agent carrying member, a detecting unit that detects a driving load placed on the drive source, and a control unit that determines appropriateness of the developing agent based on a driving load detected by the detecting unit.

DESCRIPTION OF THE PREFERRED EMBODIMENT

Figure 1:
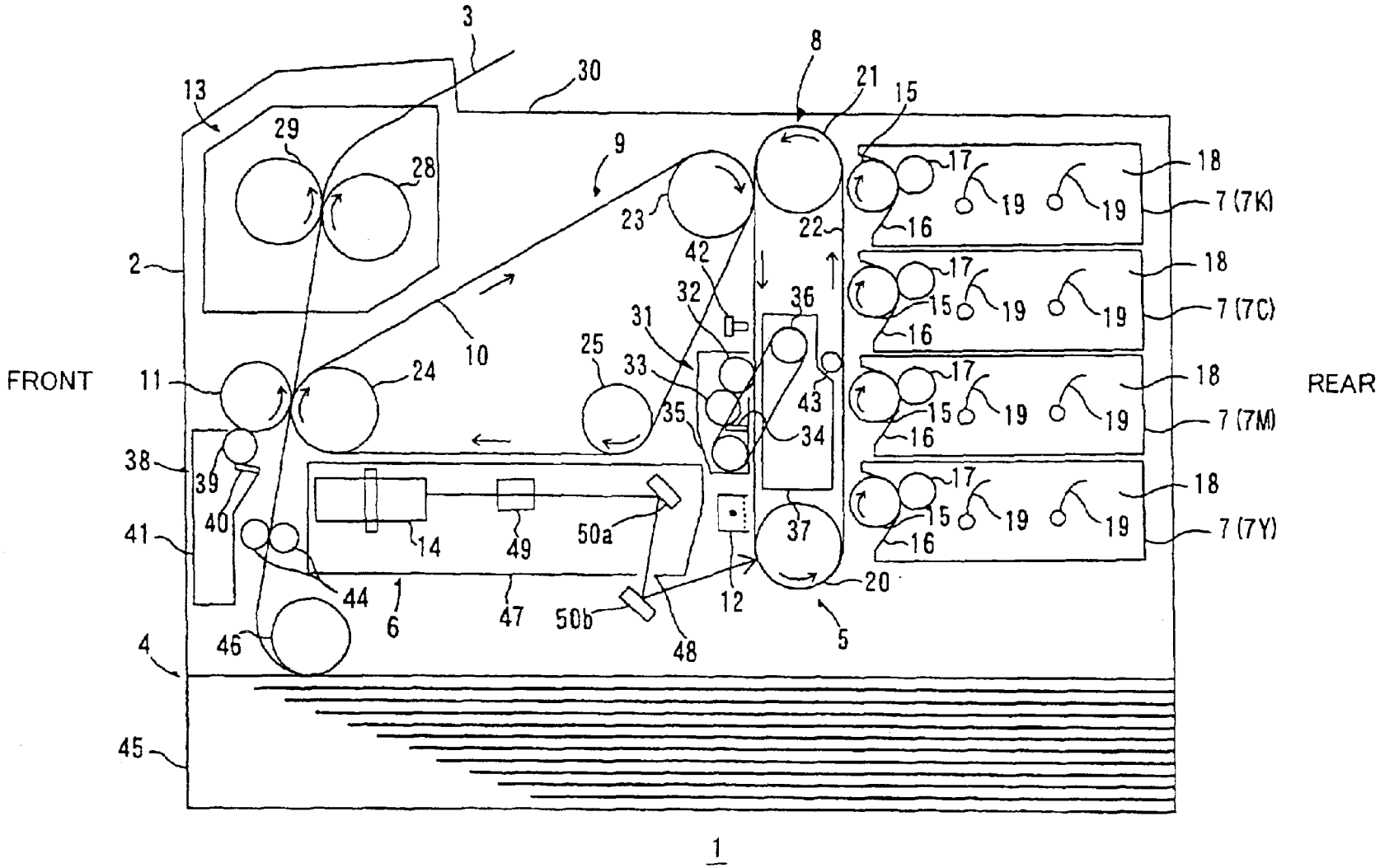
FIG. 1 is a cross-sectional view showing a color laser printer according to an embodiment of the present invention.

An image forming device according to an embodiment of the present invention will be described while referring to the accompanying drawings. FIG. 1 is a cross-sectional view showing the relevant parts of a color laser printer 1 according to the present embodiment, serving as the image forming device of the present invention. As shown in FIG. 1, the color laser printer 1 includes a paper supply unit 4, an image forming unit 5, and a casing 2 accommodating the paper supply unit 4 and the image forming device 5. The paper supply unit 4 is for supplying recording sheets 3, and the image forming unit 5 is for forming images on the recording sheets 3 supplied from the paper supply unit 4.

The paper supply unit 4 includes a paper supply tray 45 and a feeding roller 46. Recording sheets 3 are stacked in the paper supply tray 45. Drive gears (not shown) are provided for the feeding roller 46. A motor 59 (FIG. 2) described later transfers a driving force to the gears, causing the gears to rotate the feeding roller 46. Register rollers 44 are provided above the feeding roller 46. The feeding roller 46 picks up the topmost one of the recording sheets 3 stacked in the paper supply tray 45 and supplies the recording sheets 3 one at a time into the front section of the casing 2. The register rollers 44 first register the leading edge of the recording sheet 3 and then convey the recording sheet 3 to an image forming position where a transfer roller 11 and a first intermediate transfer member support roller 24 (described later) contact each other.

The image forming unit 5 includes a scanning unit 6, a plurality of (four) developing cartridges 7, a photosensitive belt mechanism 8, an intermediate transfer belt mechanism 9, a transfer roller 11, a scorotron charging device 12, and a fixing unit 13.

The scanning unit 6 is positioned above the paper supply unit 4 in the casing 2 and below the intermediate transfer belt mechanism 9 and includes a scanner casing 47 disposed substantially parallel to the lower surface of an intermediate transfer belt 10 (described later) of the intermediate transfer belt mechanism 9. Within the scanner casing 47, the scanning unit 6 includes a laser-emitting element (not shown) , a polygon mirror 14 that is driven to rotate, a lens 49, and a reflecting mirror 50*a*. Outside of the scanner casing 47, the scanning unit 6 includes a reflecting mirror 50*b* disposed on the lower back side of the scanner casing 47. In the scanning unit 6, the laser-emitting element emits a laser beam based on image data. The laser beam passes through or reflects off of the polygon mirror 14, the lens 49, the reflecting mirror 50*a*, and the reflecting mirror 50*b* in sequence, as shown by an arrow in the drawing, and is irradiated in a high-speed scanning motion onto the surface of a photosensitive belt 22 in the photosensitive belt mechanism 8 described later.

A laser beam window 48 is formed in the scanner casing 47 on the opposite side of the intermediate transfer belt 10 to allow the laser beam to be projected out through the scanner casing 47. This construction effectively prevents toner from entering the scanner casing 47.

The four developing cartridges 7 are arranged in the back portion of the casing 2, parallel to one another and aligned vertically with a prescribed interval between neighboring cartridges 7. The developing cartridges 7 include a yellow developing cartridge 7Y accommodating yellow toner, a magenta developing cartridge 7M accommodating magenta toner, a cyan developing cartridge 7C accommodating cyan toner, and a black developing cartridge 7K accommodating black toner.

Each of the developing cartridges 7 includes a developing roller 15, a layer thickness regulating plate 16, a supply roller 17, and a toner accommodating chamber 18. A connecting/separating mechanism (not shown) is provided to horizontally move a corresponding developing cartridge 7 so as to bring the developing roller 15 into and out of contact with the surface of the photosensitive belt 22.

Each toner accommodating chamber 18 is filled with a positively charged, nonmagnetic single-component toner for their respective colors yellow, magenta, cyan, and black. The toner used in these chambers 18 is a polymerized toner obtained through suspension polymerization or another polymerization method well known in the art. These methods are used to copolymerize a polymerized monomer, such as styrene or another styrene monomer, or acrylic acid, alkyl (C1–C4) acrylate, alkyl (C1–C4) meta acrylate, or another acrylic monomer. The polymerized toner is formed as particles substantially spherical in shape in order to have excellent fluidity. The toner is mixed with a coloring agent, such as carbon black, and wax, as well as an additive, such as silica, to improve fluidity. The diameter of the toner particles is about 6 $\mu$m to 10 $\mu$m.

A plurality (two in the present embodiment) of agitators 19 is provided in the toner accommodating chamber 18, spaced at a prescribed interval from front to back. When driven to rotate, these agitators 19 efficiently circulate the toner within the toner accommodating chamber 18 and supply toner from the toner accommodating chamber 18 to the supply roller 17.

The supply roller 17 and the developing roller 15 in each developing cartridge 7 contact each other with a certain degree of pressure and are capable of rotating in a contacted state. The developing roller 15 is configured to rotate in the clockwise direction in the drawing, so that the outer surface of the developing roller 15 moves upward at the point of contact with the photosensitive belt 22 (nip point) described later. The developing roller 15 applies a prescribed developing bias to the photosensitive belt 22. The layer thickness regulating plate 16 is disposed below the supply roller 17 and puts pressure on the surface of the developing roller 15 opposite the side opposing the photosensitive belt 22.

Accordingly, toner accommodated in the toner accommodating chamber 18 is supplied to the supply roller 17 by the rotation of the agitators 19. Then, the toner is supplied to the developing roller 15 by the rotation of the supply roller 17. At this time, a friction between the supply roller 17 and the developing roller 15 charges the toner to a positive charge. When the toner on the surface of the developing roller 15 is brought to a position interposed between the developing roller 15 and the layer thickness regulating plate 16, a uniform thin layer of toner is formed on the surface of the developing roller 15. At this time, friction between the developing roller 15 and the layer thickness regulating plate 16 further charges the toner to a sufficient positive charge.

The photosensitive belt mechanism 8 is disposed next to the four developing cartridges 7 toward the front of the casing 2. The photosensitive belt mechanism 8 includes a photosensitive member support roller 20, a photosensitive member drive roller 21, and a photosensitive belt 22. The photosensitive member support roller 20 is positioned on the bottom of the photosensitive belt mechanism 8 across from the yellow developing cartridge 7Y. The photosensitive member drive roller 21 is disposed at the top of the photosensitive belt mechanism 8 above and in vertical alignment with the photosensitive member support roller 20 and across from the black developing cartridge 7K. The photosensitive belt 22 is an endless belt looped around the photosensitive member support roller 20 and the photosensitive member drive roller 21. The surface of the photosensitive belt 22 includes a photosensitive layer formed of an organic photosensitive material. The photosensitive belt 22 is extended vertically in order to oppose and contact each of the developing rollers 15.

Drive gears not shown in the drawing are provided on the photosensitive member drive roller 21. A driving force generated by the motor 59 (FIG. 2) is transferred to these driving gears, driving the photosensitive member drive roller 21 to rotate in the counterclockwise direction of FIG. 1. With the photosensitive member support roller 20 configured to follow in the counterclockwise direction, the photosensitive belt 22 runs around the photosensitive member support roller 20 and the photosensitive member drive roller 21 in the counterclockwise direction. As a result, the photosensitive belt 22 moves from the developing roller 15 of the yellow developing cartridge 7Y positioned on the bottom toward the developing roller 15 of the black developing cartridge 7K positioned on the top. In other words, the photosensitive belt 22 moves upward at the points of contact (nip points) with each developing roller 15, moving in the same direction as the developing rollers 15. A tension roller 43 is also provided in the photosensitive belt mechanism 8 on the inner side of the photosensitive belt 22 between the photosensitive member support roller 20 and the photosensitive member drive roller 21, such that the photosensitive belt 22 is interposed between the tension roller 43 and the developing cartridges 7.

The intermediate transfer belt mechanism 9 is disposed above the scanning unit 6 and next to the photosensitive belt mechanism 8 toward the front of the casing 2, that is, on the opposite side of the photosensitive belt mechanism 8 from the developing cartridges 7. The intermediate transfer belt mechanism 9 has three rollers, including an intermediate transfer member driving roller 23, a first intermediate transfer member support roller 24, and a second intermediate transfer member support roller 25; and an intermediate transfer belt 10 that is an endless belt formed of a resin, such as a conductive polycarbonate or polyimide including dispersed carbon or other conductive particles.

The intermediate transfer member driving roller 23 is disposed in opposition to the photosensitive member drive roller 21, such that the photosensitive belt 22 and the intermediate transfer belt 10 are interposed therebetween. The first intermediate transfer member support roller 24 is positioned diagonally down and toward the front of the casing 2 in relation to the intermediate transfer member driving roller 23 and is disposed in opposition to the transfer roller 11, such that the intermediate transfer belt 10 is interposed therebetween. The second intermediate transfer member support roller 25 is positioned below the intermediate transfer member driving roller 23 and toward the back of the casing 2 in relation to the first intermediate transfer member support roller 24. Hence, the intermediate transfer member driving roller 23, the first intermediate transfer member support roller 24, and the second intermediate transfer member support roller 25 are arranged in a substantially triangular shape around which the intermediate transfer belt 10 is looped.

Drive gears not shown in the drawing are provided on the intermediate transfer member driving roller 23. The driving force of the motor 59 (FIG. 2) is transferred to these drive gears to drive the intermediate transfer member driving roller 23 to rotate in the clockwise direction of FIG. 1. The first intermediate transfer member support roller 24 and the second intermediate transfer member support roller 25 are configured to follow the intermediate transfer member driving roller 23 by rotating in the clockwise direction, such that the intermediate transfer belt 10 runs in the clockwise direction around the intermediate transfer member driving roller 23, the first intermediate transfer member support roller 24, and the second intermediate transfer member support roller 25. As a result, the intermediate transfer belt 10 opposes and contacts the photosensitive belt 22 at the intermediate transfer member driving roller 23 and moves in the same direction as the photosensitive belt 22 at this point of contact (nip point).

The transfer roller 11 is disposed in opposition to the first intermediate transfer member support roller 24, with the intermediate transfer belt 10 interposed therebetween, such that the transfer roller 11 contacts the surface of the intermediate transfer belt 10. The transfer roller 11 rotates in the counterclockwise direction, such that the surface of the transfer roller 11 moves in the same direction as the intermediate transfer belt 10 at the point of contact with the intermediate transfer belt 10 (nip point). Further, the transfer roller 11 applies a transfer bias to the intermediate transfer belt 10.

The charging device 12 is disposed not in contact with the surface of the photosensitive belt 22, but a prescribed distance therefrom, and is positioned near the photosensitive member support roller 20 on the upstream side of the photosensitive member support roller 20 in relation to the movement of the photosensitive belt 22. The charging device 12 is a positive-charging scorotron type charger for generating a corona discharge from a tungsten wire or the like. The charging device 12 is configured to apply a positive charge uniformly across the surface of the photosensitive belt 22.

After the charging device 12 applies a uniform positive charge to the surface of the photosensitive belt 22, the surface is exposed by the high-speed scanning of the laser beam emitted from the scanning unit 6, thereby forming electrostatic latent images according to prescribed image data.

When the connecting/separating mechanism (not shown) places the developing roller 15 of a particular developing cartridge 7 in contact with the photosensitive belt 22 on which an electrostatic latent image has been formed, then a visible toner image is formed on the photosensitive belt 22 in the single color of the toner stored in that specific developing cartridge 7. When the visible toner image of this color formed on the photosensitive belt 22 is brought opposite the intermediate transfer belt 10, the toner image is transferred onto the intermediate transfer belt 10. A multicolor image is formed by sequentially overlaying images of different colors on the intermediate transfer belt 10.

For example, the connecting/separating mechanism (not shown) moves the yellow developing cartridge 7Y positioned at the bottom of the casing 2 horizontally toward the front of the casing 2, such that the developing roller 15 in the yellow developing cartridge 7Y contacts the photosensitive belt 22 on which a latent image has been formed, and the developing cartridges 7M, 7C, and 7K are moved horizontally toward the back of the casing 2, thereby separating the respective developing rollers 15 from the photosensitive belt 22. Accordingly, a visible image in yellow is formed on the photosensitive belt 22 by the yellow toner stored in the yellow developing cartridge 7Y. When the visible image on the photosensitive belt 22 moves across from the intermediate transfer belt 10, the yellow image is transferred to the intermediate transfer belt 10.

By repeatedly forming latent images on the photosensitive belt 22 as described above, appropriately moving each developing cartridge 7 horizontally with the connecting/separating mechanism, the developing roller 15 of the magenta developing cartridge 7M positioned second from the bottom can be placed in contact with the photosensitive belt 22, while the remaining developing rollers 15 are separated therefrom, to form a visible image in magenta on the photosensitive belt 22 using the magenta toner stored in the magenta developing cartridge 7M. Similarly when the magenta visible image moves across from the intermediate transfer belt 10, the magenta image is transferred to the intermediate transfer belt 10 and superimposed on the yellow toner image that was transferred previously.

The same operations are repeated using cyan toner stored in the cyan developing cartridge 7C and black toner stored in the black developing cartridge 7K to form a multicolor image on the surface of the intermediate transfer belt 10. The multicolor image formed on the surface of the intermediate transfer belt 10 is transferred at once onto the recording sheet 3, as the recording sheet 3 passes between the intermediate transfer belt 10 and the transfer roller 11.

In this color laser printer 1, a charge eliminating lamp 42 is provided for removing the charge from the surface of the photosensitive belt 22 after the image has been transferred. This charge eliminating lamp 42 is positioned on the opposite side of the photosensitive belt 22 from the developing cartridges 7 downstream from the nip point between the intermediate transfer belt 10 and the photosensitive belt 22 and upstream from the charging device 12 in relation to the moving direction of the photosensitive belt 22. With this configuration, the charge eliminating lamp 42 removes the charge from the surface of the photosensitive belt 22 after visible images from each color have been transferred to the intermediate transfer belt 10.

A belt cleaner 31 is provided for recovering residual toner on the photosensitive belt 22. The belt cleaner 31 is disposed next to the second intermediate transfer member support roller 25 and on the opposite side of the photosensitive belt 22 from the developing cartridges 7. The belt cleaner 31 includes a belt cleaning roller 32, a recovery roller 33, a scraping blade 34, and a cleaning box 35 accommodating the belt cleaning roller 32, the recovery roller 33, and the scraping blade 34. A recovery box 37 is linked to the cleaning box 35 via a connecting tube 36.

The cleaning box 35 is positioned downstream from the charge eliminating lamp 42 and upstream from the charging device 12 in relation to the moving direction of the photosensitive belt 22 and on the opposite side of the photosensitive belt 22 from the developing cartridges 7. An opening is formed in the portion of the cleaning box 35 facing the photosensitive belt 22. The belt cleaning roller 32 is rotatably supported in the opening of the cleaning box 35 in contact with the photosensitive belt 22. The belt cleaning roller 32 is configured to apply a cleaning bias to the photosensitive belt 22. The recovery roller 33 is rotatably disposed in contact with the belt cleaning roller 32 on the opposite side from the photosensitive belt 22. The recovery roller 33 is configured to apply a recovery bias to the belt cleaning roller 32. The scraping blade 34 is disposed in contact with the surface of the recovery roller 33 from the bottom.

The recovery box 37 is disposed within the photosensitive belt 22 that is wrapped around the photosensitive member support roller 20 and the photosensitive member drive roller 21. The recovery box 37 is connected to the cleaning box 35 via the connecting tube 36 disposed on the side of the photosensitive belt 22.

With this construction, toner remaining on the surface of the photosensitive belt 22 after the visible image is transferred to the intermediate transfer belt 10 is recaptured electrically by the belt cleaning roller 32 as the photosensitive belt 22 moves across therefrom. When residual toner captured on the belt cleaning roller 32 contacts the recovery roller 33, the toner is electrically collected by the recovery roller 33, scraped off by the scraping blade 34, and collected via the connecting tube 36 in the recovery box 37.

The fixing unit 13 is disposed above the transfer roller 11 on the opposite side of the photosensitive belt mechanism 8 from the developing cartridges 7. The fixing unit 13 includes a heating roller 28 and a pressure roller 29 applying pressure to the heating roller 28. The heating roller 28 is formed of metal and includes a halogen lamp for generating heat. Multicolor images transferred onto the surface of the recording sheet 3 are thermally fixed onto the recording sheet 3 as the recording sheet 3 passes between the heating roller 28 and the pressure roller 29. After the multicolor image is fixed on the recording sheet 3 in the fixing unit 13, the recording sheet 3 is discharged onto a discharge tray 30 formed on top of the casing 2.

A transfer cleaner 38 is provided in the color laser printer 1 in order to collect toner from the surface of the transfer roller 11. The transfer cleaner 38 is disposed below the transfer roller 11 and includes a transfer cleaning roller 39, a scraping blade 40, and a cleaning box 41 accommodating the transfer cleaning roller 39 and the scraping blade 40. The cleaning box 41 is disposed facing the transfer roller 11 downstream from the nip point between the intermediate transfer belt 10 and the transfer roller 11 in relation to the moving direction of the transfer roller 11. An opening is formed in the part of the cleaning box 41 facing the transfer roller 11, and the transfer cleaning roller 39 is rotatably supported in the opening formed in the cleaning box 41 to contact the transfer roller 11 from below. The transfer cleaning roller 39 is configured to apply a cleaning bias to the transfer roller 11. The scraping blade 40 is disposed in contact with the surface of the transfer cleaning roller 39 on the opposite side from the transfer roller 11.

When toner deposited on the transfer roller 11 is brought into contact with the transfer cleaning roller 39 by the rotation of the transfer roller 11, the toner is electrically captured on the transfer cleaning roller 39. This residual toner captured on the transfer cleaning roller 39 is scraped off by the scraping blade 34 and collected in the cleaning box 41.

As described above, the color laser printer 1 of the present embodiment uses substantially spherical shaped polymerized toner that has good fluidity, enabling the formation of excellent images. Accordingly, the color laser printer 1 can form extremely high-quality images. Moreover, by putting the developing roller 15 in contact with both the supply roller 17 and the layer thickness regulating plate 16, it is possible to maintain a reliable charge on the toner passing therebetween in order to achieve good image formation in this nonmagnetic single-component developing system.

On the other hand, the printing quality will degrade markedly if a nonspherical ground toner is used in the color laser printer 1 designed to use substantially spherical polymerized toner. Further, use of this ground toner will invite damage to the developing roller 15, the supply roller 17, and the layer thickness regulating plate 16 that contact one another, as well as the photosensitive belt 22 that contacts the developing roller 15, the agitators 19 that agitate the toner, and the like, potentially resulting in great damage to the color laser printer 1.

Accordingly, the color laser printer 1 of the present embodiment determines whether the toner is appropriate for the color laser printer 1 based on the load (torque) applied to the motor 59.

More specifically, a central process unit (CPU) 51 (FIG. 2) of the color laser printer 1 sets a reference current value X to a drive current value required to achieve a prescribed rotational speed of the motor 59 when substantially spherical polymerized toner is used in the color laser printer 1. This reference current value X serves as the reference power value. A drive current value M, which is a measured drive power, is always greater than the reference current value X when nonspherical ground toners are used. Hence, the CPU 51 can determine that the toner is inappropriate when the drive current value M is greater than the reference current value X. Accordingly, the color laser printer 1 can reliably determine whether nonspherical ground toner is being used with a simple construction, thereby easily and reliably preventing the formation of images using nonspherical ground toner and damage to the developing roller 15, the layer thickness regulating plate 16, and the supply roller 17, as well as to the photosensitive belt 22, the agitators 19, and the like as the result of using nonspherical ground toner. This control process will be described in more detail.

Figure 2:
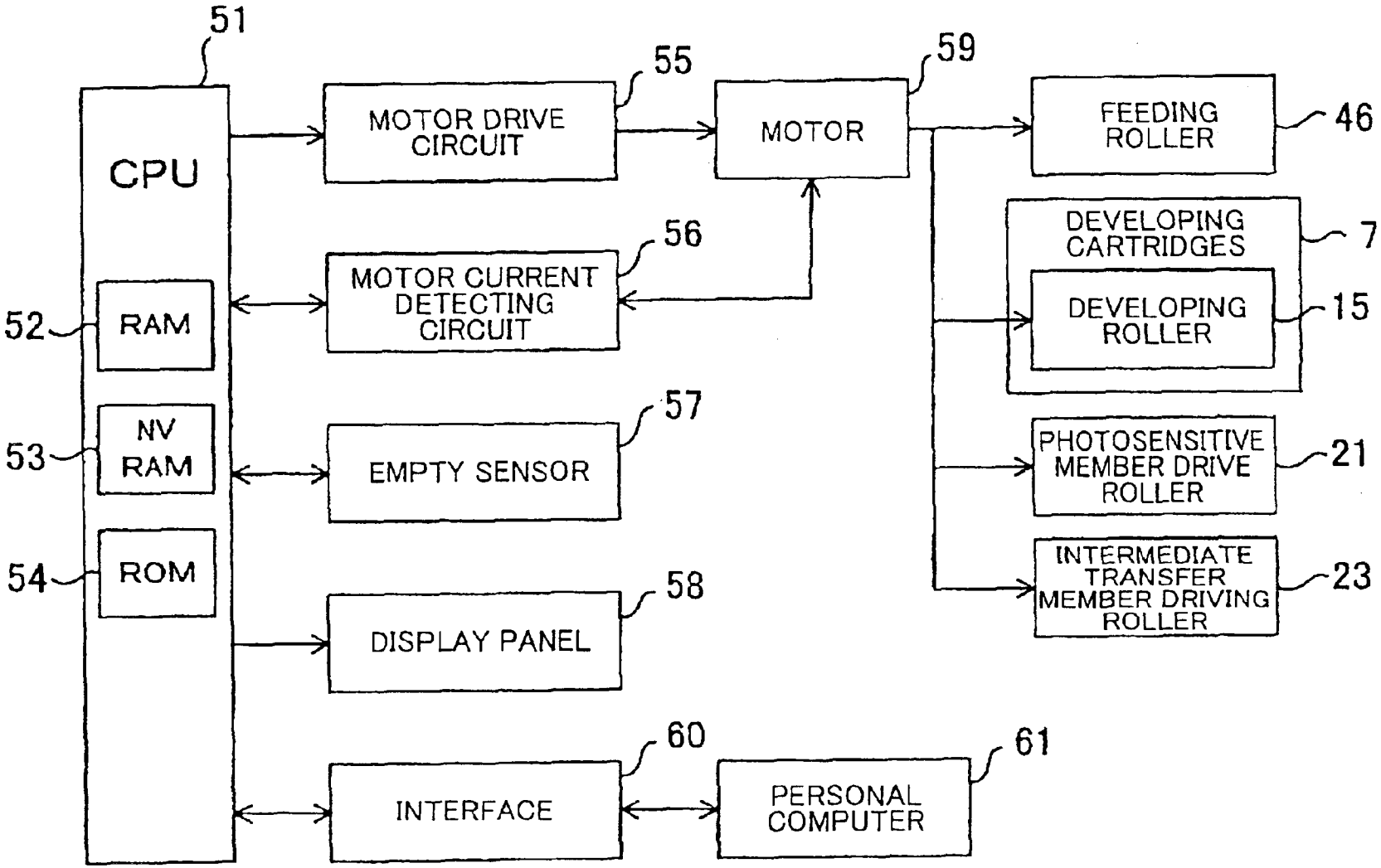
FIG. 2 is a block diagram showing a control system of the color laser printer of FIG. 1.

FIG. 2 shows a block diagram of a control system for executing the control process of the present embodiment. As shown in FIG. 2, the CPU 51 in the color laser printer 1 is connected to a motor drive circuit 55, a motor current detecting circuit 56, an empty sensor 57, a display panel 58, and an interface 60. The empty sensor 57 is for detecting when the toner accommodating chamber 18 is empty of toner. The display panel 58 is for displaying various settings and status of the color laser printer 1.

The CPU 51 includes a random access memory (RAM) 52, a non-volatile RAM (NVRAM) 53, and a read only memory (ROM) 54, and controls each component. The RAM 52 stores temporary numerical values inputted from the motor current detecting circuit 56, the empty sensor 57, the interface 60, and the like. The NVRAM 53 stores the reference current value X and the like described later. The ROM 54 stores various control programs for controlling the motor drive circuit 55, the motor current detecting circuit 56, the empty sensor 57, the display panel 58, and the like. The control programs include a main routine program for executing a normal printing process and a program for executing an interrupt process at a detection timing described later. The NVRAM 53 is configured to store values, even when the power to the color laser printer 1 is turned OFF, by means of a backup power source.

The motor drive circuit 55 is connected to the motor 59. This motor 59 is connected to the feeding roller 46, the developing roller 15 of each developing cartridge 7, the photosensitive member drive roller 21, and the intermediate transfer member driving roller 23 via gear trains not shown. The motor drive circuit 55 drives the motor 59 at a prescribed speed of rotation. In other words, the motor 59 is driven at a fixed rate of speed by the motor drive circuit 55. When there is a larger torque on the motor 59, the drive current value M is increased. When there is a smaller torque on the motor 59, the drive current value M is decreased.

The CPU 51 controls the motor 59 to drive or stop via the motor drive circuit 55. Hence, the feeding roller 46, the developing roller 15, the photosensitive member drive roller 21, and the intermediate transfer member driving roller 23 are also driven or stopped by the CPU 51.

Although not shown in the drawings, other driven parts of the color laser printer 1, such as the transfer roller 11, the agitators 19, the connecting/separating mechanism of the developing cartridge 7, the heating roller 28, and the like, are connected to the motor 59.

The motor current detecting circuit 56 is also connected to the motor 59 for detecting the drive current of the motor 59 as the drive load placed on the motor 59. The motor current detecting circuit 56 inputs the detected drive current value M of the motor 59 into the CPU 51 at the detection timing described later.

The empty sensor 57 includes an optical sensor having a light-emitting element and a light-receiving element. Windows (not shown) are formed in two opposing walls of the toner accommodating chamber 18 for each developing cartridge 7. The light-emitting element and the light-receiving element are disposed on the outside of each window and face each other across the windows. The empty sensor 57 then detects whether the toner accommodating chamber 18 is empty according to the amount of light received by the receiving element in relation to the amount of light emitted by the emitting element and inputs a detection signal into the CPU 51.

Although not shown in FIG. 1, the display panel 58 is provided on the top surface of the casing 2 and includes a liquid crystal display unit for notifying the user of various data concerning the color laser printer 1. Through control of the CPU 51, the display panel 58 displays information on the liquid crystal display unit, indicating, for example, that a toner cartridge is out of toner, that the toner is inappropriate, that a printing process has been canceled, and the like.

A personal computer 61 is connected to the CPU 51 via the interface 60. The personal computer 61 sets various settings and conditions for printing through printer properties and displays various notification data received from the color laser printer 1.

The reference current value X is stored into the NVRAM 53 before shipment in the following manner. At the factory prior to shipment, developing cartridges 7 filled with substantially spherical polymerized toner appropriate for the color laser printer 1 are mounted in the color laser printer 1. Each developing roller 15 is actually driven by the motor 59 one after the other, while the motor current detecting circuit 56 detects the drive current of the motor 59 and stores a reference current value X into the NVRAM 53 based on the detected drive current value. More specifically, the motor current detecting circuit 56 detects an initial drive current of the motor 59 a plurality of times (for example, ten times) and stores a value 120% times the average drive current value for the plurality of detections into the NVRAM 53 as the reference current value X.

The CPU 51 also controls the timing in which the motor current detecting circuit 56 detects the drive current value M (hereinafter referred to as the detection timing). Detection timings are appropriate timings set in the ROM 54 that require the motor 59 to be operating. Examples of detection timings include a timing in which any of the developing cartridges 7 is replaced, a timing during the developing stage of the printing process between conveying recording sheets 3 being printed in sequence, a timing when the power of the color laser printer 1 is turned ON, a timing when the printing process begins, and other appropriate timings.

The timing at which the developing cartridge 7 is replaced is the timing at which an out-of-toner detection is cleared after the empty sensor 57 detected an empty cartridge. More specifically, when the empty sensor 57 detects that any of the developing cartridges 7 has run out of toner, the CPU 51 controls the liquid crystal display unit on the display panel 58 to display a message indicating that a cartridge is out of toner. After the user subsequently replaces the relevant developing cartridge 7, the CPU 51 clears the out-of-toner detection setting, removing the displayed message on the liquid crystal display unit. The timing at which this detection is cleared is equivalent to the timing at which a developing cartridge 7 is replaced. At this timing, the motor 59 is driven for a prescribed interval through control by the CPU 51 in order to measure the drive current value M. The motor 59 is driven one interval for each developing roller 15.

The timing between recording sheets 3 printed sequentially and during the developing stage of the printing process is, for example, after a multicolor image formed on the intermediate transfer belt 10 is transferred at once onto the recording sheet 3, as described above, and when the developing rollers 15 are being driven to form single-color visible images on the photosensitive belt 22 before the next recording sheet 3 is supplied. At this timing, the feeding roller 46 is not conveying the next recording sheet 3, but the developing rollers 15 are being driven one at a time in sequence.

The timing at which the electric power to the color laser printer 1 is turned ON occurs when the printer 1 is started up after power to the printer 1 is turned ON. At this timing, the motor 59 is driven for a prescribed interval through control by the CPU 51 in order to measure the drive current value M.

The timing for beginning printing is, for example, when the color laser printer 1 is restored from a sleep mode in order to perform the next printing process after the color laser printer 1 is put in the sleep mode following a prescribed printing process. At this timing, the motor 59 is driven for a prescribed interval through control by the CPU 51 in order to measure the drive current value M. Each developing roller 15 is driven one at a time in succession.

The CPU 51 determines that the toner is inappropriate when the drive current value M detected during one of the above detection timings is larger than the reference current value X.

Next, the control process will be described in detail with reference to the flowchart of FIG. 3.

While the color laser printer 1 is ON, execution of a normal printing process, settings in the standby state, and the like are executed according to a main routine by the control program. When the detection timings described above are recognized in the main routine, a following interrupt process is executed. To begin with, a variable N is initialized to 0 in S1. Then, in S2, the motor current detecting circuit 56 detects the drive current value M of the motor 59 for each developing roller 15, while each developing roller 15 is driven one after another in sequence.

In S3, the CPU 51 determines whether each detected drive current value M of the motor 59 is greater than the reference current value X. If the CPU 51 determines that all the detected drive current values M are less than or equal to the reference current value X (S3:NO) , then the interrupt process ends and the main routine is resumed.

On the other hand, if one or more of the drive current value M is determined to be larger than the reference current value X (S3:YES), then the variable N is incremented by one in S4. In S5, the CPU 51 determines whether or not the variable N is equal to 10. If not (S5:NO) , then the process returns to S2, where the motor current detecting circuit 56 detects the drive current value M of the motor 59 for each of one or more developing roller 15 for which the drive current value M has been determined to be greater than the reference current value X. The CPU 51 compares each drive current value M to the reference current value X in S3. If one or more of the detected drive current value(s) M is again determined to be greater than the reference current value X (S3:YES), then the process from S4 to S3 are repeated.

If all the detected one or more drive current value(s) M of the motor 59 is determined to be less than or equal to the reference current value X during the plurality of detections described above (S3:NO), then the interrupt process ends and the main routine is resumed.

When it is determined that the variable N is equal to 10 in S5, that is, when the drive current value M for any of the developing roller 15 is determined to be greater than the reference current value X for ten consecutive times (S5:YES), then in S6 the CPU 51 determines that the toner is inappropriate, so that the driving of the motor 59 is stopped, and the printing process is cancelled. In addition, in S6, a notification message for the user is displayed in the liquid crystal display unit of the display panel 58 indicating that the printing process has been canceled due to the use of inappropriate toner and indicating that the developing cartridge 7 accommodates the inappropriate toner. It is also possible to display this notification on the display unit of the personal computer 61.

That is, if even one of detected drive current values M of the motor 59 is greater than the reference current value X (S3:YES), then the motor current detecting circuit 56 rechecks the drive current value M of the motor 59 a plurality of times while driving the developing roller 15 for which the drive current value M exceeded the reference current value X. In this manner, an incorrect detection is avoided. In this embodiment, the standard for determining that the toner is inappropriate is when the drive current value M is determined to be larger than the reference current value X a predetermined number of times consecutively (10 times in this embodiment).

In this manner, the CPU 51 of the color laser printer 1 can determine whether the toner is appropriate based on the load applied to the motor 59 driving the developing roller 15 to rotate. More specifically, the drive current of the motor 59 is detected, and this drive current value M is compared to the reference current value X indicating the drive current of the motor 59 required when appropriate substantially spherical polymerized toner is used in order to determine the appropriateness of the toner being used. Hence, the CPU 51 can accurately determine the appropriateness of toner through a simple construction, even when the user mistakenly uses inappropriate nonspherical ground toner, thereby reliably preventing the formation of images with inappropriate toner and damage to the color laser printer 1.

Further, the CPU 51 of the color laser printer 1 can easily and reliably detect the timing at which a developing cartridge 7 is replaced based on the timing in which an empty cartridge detection detected by the motor 59 is cleared. Accordingly, the CPU 51 can determine the appropriateness of toner in a replaced developing cartridge 7 at the optimal timing. In this way, the color laser printer 1 can even more reliably prevent the formation of images with inappropriate toner and damage to the color laser printer 1 caused by such toner.

Further, the CPU 51 of the color laser printer 1 detects a drive current between recording sheets 3 being printed sequentially and during the developing phase of the printing process.

For example, if the drive current of the motor 59 was detected while the feeding roller 46 was conveying the recording sheet 3 and if a paper jam should occur with the sheet 3 being conveyed by the feeding roller 46, then an excess load would be placed on the motor 59, causing the drive current of the motor 59 to rise. As a result, the CPU 51 might mistakenly determine that the toner is inappropriate.

However, if the drive current is detected when the developing roller 15 is driven but when the feeding roller 46 is not conveying the recording sheet 3, it is possible to avoid mistaken determinations resulting from paper jams and the like.

Further, the reference current value X serving as the standard for detecting the load applied to the motor 59 in the color laser printer 1 is set in the factory prior to shipment based on the initial drive current value for actually driving the developing roller 15 with the motor 59 by using a substantially spherical polymerized toner appropriate for the color laser printer 1. Accordingly, the color laser printer 1 can more accurately determine the appropriateness of toner based on individual specifications of the color laser printer 1.

Figure 3:
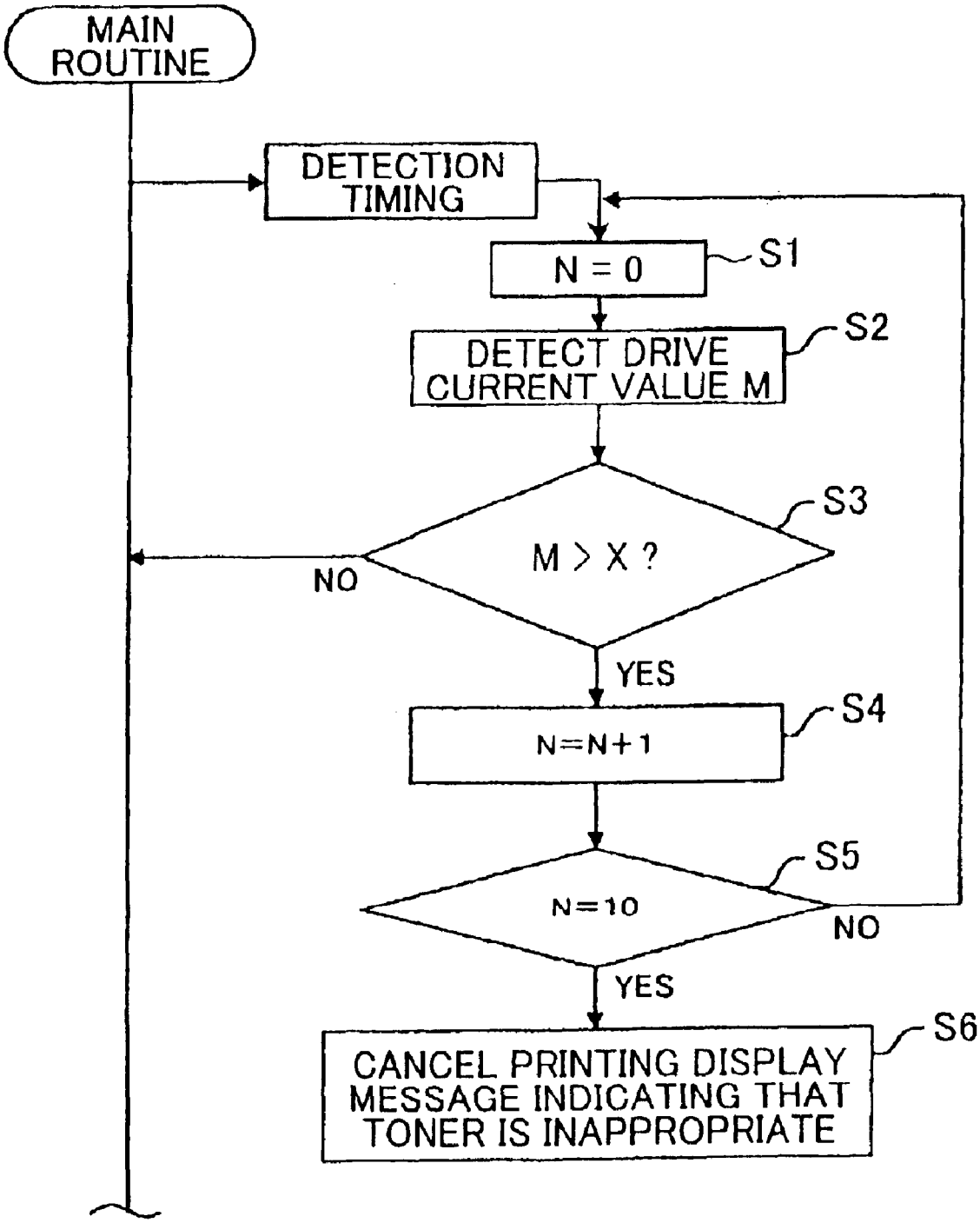
FIG. 3 is a flowchart representing a control process executed by the color laser printer of FIG. 1.

As described in FIG. 3, when the CPU 51 determines at a detection timing that the detected drive current value M is greater than the reference current value X, then the drive current of the motor 59 is detected a plurality of times in order to reduce the likelihood of a mistaken detection. Hence, the precision for determining the appropriateness of toner can be further increased.

When the CPU 51 determines that the toner is inappropriate, the driving of the motor 59 is halted and the printing process is cancelled. At the same time, the user is notified by displaying a message on the display panel 58 indicating that the toner is inappropriate. Therefore, the color laser printer 1 can reliably prevent the formation of images with inappropriate toner and damage to the color laser printer 1 by prompting the user to use appropriate toner.

While some exemplary embodiments of this invention have been described in detail, those skilled in the art will recognize that there are many possible modifications and variations which may be made in these exemplary embodiments while yet retaining many of the novel features and advantages of the invention.

For example, in the embodiment described above, the reference current value X is determined in the factory prior to shipment for each individual color laser printer 1 and is set based on the initial drive current value while actually driving the developing roller 15 using a substantially spherical polymerized toner appropriate for the color laser printer 1. However, the reference current value X for color laser printers 1 of the same model can be set to a predetermined drive current value based on empirical knowledge. In this case, it is possible to standardize the method of determining the appropriateness of toner, thereby simplifying the control process while still achieving accurate determinations.

In the embodiment described above, the same motor 59 is used to drive both the developing roller 15 and the feeding roller 46. However, the developing roller 15 and the feeding roller 46 could be driven independently using separate motors. In the latter case, it is possible to detect the drive current value M of the motor driving the developing roller 15 while the feeding roller 46 is conveying the paper 3.

In the above description, the motor current detecting circuit 56 detects the drive current value M of the motor 59 to be the load applied to the drive of the motor 59. However, the load (torque) on the motor 59 can also be directly detected mechanically using a torque detecting device or the like.

The above description uses an example of a color laser printer 1 as the image forming device of the present invention. However, the image forming device of the present invention can also be a monochrome laser printer.

What is claimed is:

1. An image forming device comprising:

a casing;

a developing device that is detachably mounted in the casing, the developing device including a developing agent carrying member for carrying a developing agent;

a drive source for driving the developing agent carrying member;

a detecting unit that detects a driving load placed on the drive source; and a control unit that determines whether the developing agent has appropriate shape or inappropriate shape based on the driving load detected by the detecting unit.

2. The image forming device according to claim 1, wherein the detecting unit detects a driving power of the drive source as the driving load placed on the drive source, and the control unit determines whether the developing agent has the appropriate shape or the inappropriate shape by comparing a value of the detected driving power to a reference power value.

3. The image forming device according to claim 2, wherein the detecting unit detects the driving power at a timing of when the developing device is replaced.

4. The image forming device according to claim 2, further comprising an empty sensor, wherein:

the developing device further includes an accommodating unit that accommodates the developing agent to be supplied to the developing agent carrying member;

the empty sensor detects when the accommodating unit is empty of the developing agent; and the detecting unit detects the driving power at a timing in which the detection by the empty sensor is cleared after the empty sensor detects that the accommodating unit is empty.

5. The image forming device according to claim 2, further comprising a transport mechanism that transports a recording medium, wherein the drive source drives the transport mechanism to transport the recording medium, and the detecting unit detects the driving power at a timing when the drive source is driving the developing agent carrying member but is not driving the transport mechanism.

6. The image forming device according to claim 2, wherein the reference power value is a predetermined value.

7. The image forming device according to claim 2, wherein the reference power value is determined based on an initial driving power at which the drive source actually drives the developing agent carrying member.

8. The image forming device according to claim 2, wherein the detecting unit detects the driving power a plurality of times at a detection timing.

9. The image forming device according to claim 2, wherein the control unit determines that the developing agent has the inappropriate shape when the value of the detected driving power exceeds the reference power value.

10. The image forming device according to claim 9, wherein the value of the detected driving power is equal to or less than the reference power value when the developing agent is toner particles substantially spherical in shape.

11. The image forming device according to claim 9 wherein the developing device employs a nonmagnetic single-component developing system and includes a supplying member in contact with the developing agent carrying member for supplying the developing agent to the developing agent carrying member, and a layer thickness regulating member in contact with the developing agent carrying member for forming a thin layer of the developing agent on the developing agent carrying member.

12. The image forming device according to claim 2, wherein the detecting unit is an electric current detecting circuit that detects an electric current as the driving power of the drive source.

13. The image forming device according to claim 1, wherein the control unit controls the drive source to stop driving when the control unit determines that the developing agent has the inappropriate shape.

14. The image forming device according to claim 1, further comprising a display unit, wherein the control unit controls the display unit to display a message indicating that the developing agent has the inappropriate shape when the control unit determines inappropriateness of the developing agent.

15. The image forming device according to claim 1, wherein the developing agent has the appropriate shape if the developing agent is a polymerized toner substantially spherical in shape, and the developing agent has the inappropriate shape if the developing agent is a ground toner.

16. An image forming device comprising:

a casing;

a developing device that is detachably mounted in the casing, the developing device including a developing agent carrying member for carrying a developing agent and an accommodating unit that accommodates the developing agent to be supplied to the developing agent carrying member;

a drive source for driving the developing agent carrying member;

a detecting unit that detects a driving load placed on the drive source; and an empty sensor that detects when the accommodating unit is empty of the developing agent, wherein the detecting unit detects a driving power of the drive source as the driving load placed on the drive source, the detecting unit detecting the driving power at a timing in which the detection by the empty sensor is cleared after the empty sensor detects that the accommodating unit is empty.

17. An image forming device comprising:

a casing;

a developing device that is detachably mounted in the casing, the developing device including a developing agent carrying member for carrying a developing agent;

a drive source for driving the developing agent carrying member;

a detecting unit that detects a driving load placed on the drive source; and a transport mechanism that transports a recording medium, wherein the drive source drives the transport mechanism to transport the recording medium, wherein the detecting unit detects a driving power of the drive source as the driving load placed on the drive source, the detecting unit detecting the driving power at a timing when the drive source is driving the developing agent carrying member but is not driving the transport mechanism.

18. An image forming device comprising:

a casing;

a developing device that is detachably mounted in the casing, the developing device including a developing agent carrying member for carrying a developing agent;

a drive source for driving the developing agent carrying member;

a detecting unit that detects a driving power of the drive source as a driving load placed on the drive source; and a control unit that compares a value of the detected driving power to a reference power value, the reference power value being determined based on an initial driving power at which the drive source actually drives the developing agent carrying member.

* * * * *